US005121660A

United States Patent [19]

Kramer

[11] Patent Number: 5,121,660

[45] Date of Patent: Jun. 16, 1992

[54] RAZOR BLADE TECHNOLOGY

[75] Inventor: Carolyn M. Kramer, Moorestown, N.J.

[73] Assignee: The Gillette Company, Boston, Mass.

[21] Appl. No.: 773,221

[22] Filed: Oct. 9, 1991

Related U.S. Application Data

[62] Division of Ser. No. 495,475, Mar. 19, 1990, Pat. No. 5,056,227.

[51] Int. Cl.[5] ..... B26B 21/54; B24B 1/00

[52] U.S. Cl. ..... 76/104.1; 76/DIG. 8; 51/285

[58] Field of Search ..... 76/101.1, DIG. 8, 24.1, 76/24.5, 104.1, 119; 30/346.54, 350, 346.53; 51/281 R, 285; 156/625, 647, 654, 667

[56] References Cited

U.S. PATENT DOCUMENTS

| | | | |
|---|---|---|---|
| 2,555,214 | 5/1951 | Wallach . | |
| 3,501,334 | 3/1970 | Flaherty | 30/346.54 |
| 3,514,856 | 6/1970 | Camp . | |
| 3,543,402 | 12/1970 | Seager . | |
| 3,607,485 | 9/1971 | Bailey | 156/24 |
| 3,703,766 | 11/1972 | Tibbals | 30/346.53 |
| 3,761,373 | 9/1973 | Sastri . | |
| 3,829,969 | 8/1974 | Fischbeim et al. | 30/346.54 |
| 3,834,265 | 9/1974 | Tafapolsky | 83/651 |
| 3,911,579 | 10/1975 | Lane . | |
| 3,960,608 | 6/1976 | Cole | 30/346.54 |
| 4,534,827 | 8/1985 | Henderson . | |
| 4,702,004 | 10/1987 | Haythornthwaite . | |
| 5,048,191 | 9/1991 | Hahn | 76/104.1 |

FOREIGN PATENT DOCUMENTS

| | | | |
|---|---|---|---|
| 60-58805 | 4/1985 | Japan . | |
| 60-58806 | 4/1985 | Japan . | |
| 1423831 | 2/1976 | United Kingdom . | |
| 1544129 | 4/1979 | United Kingdom | 76/104.1 |
| 1544130 | 4/1979 | United Kingdom | 76/104.1 |

*Primary Examiner*—Roscoe V. Parker
*Attorney, Agent, or Firm*—Fish & Richardson

[57] ABSTRACT

A process for forming a razor blade includes the steps of providing a polycrystalline ceramic substrate of less than two micrometer grain size, mechanically abrading an edge of the polycrystalline ceramic substrate to form a sharpened edge thereon that has an included angle of less than twenty degrees; and sputter-etching the sharpened edge to reduce the tip radius to less than 300 Angstroms and form a cutting edge. The resulting blades exhibit excellent shaving properties.

10 Claims, 1 Drawing Sheet

RAZOR BLADE TECHNOLOGY

This is a divisional of application Ser. No. 07/495,475, filed Mar. 19, 1990 and now U.S. Pat. No. 5,056,227.

This invention relates to processes for producing a razor blade or similar cutting tool with an extremely sharp and durable cutting edge and to improved razor blades.

While a number of attempts have been made to produce satisfactory cutting edges in ceramic substrates because such materials have desirable properties of high strength, hardness and corrosion resistance, such attempts employing mechanical sharpening techniques have encountered difficulties as the edge areas undergo considerable stress during mechanical sharpening, making them prone to fracture.

In accordance with one aspect of the invention, there is provided a process for forming a razor blade that includes the steps of providing a polycrystalline ceramic substrate of less than two micrometer grain size, mechanically abrading an edge of the polycrystalline ceramic substrate to form a sharpened edge thereon that has an included angle of less than twenty degrees; and sputter-etching the sharpened edge to reduce the tip radius to less than 300 Angstroms and form a cutting edge. The resulting blades exhibit excellent shaving properties and adequate shaving life.

In a preferred process, the ceramic substrate is abraded in a sequence of grinding, rough honing and finish honing steps with diamond abrasive material to form a sharpened edge that has a tip radius in the range of 600 to 1000 Angstroms. Preferably, the polycrystalline ceramic substrate material is selected from the group of silicon carbide, silicon nitride, mullite, hafnia, yttria, zirconia, and alumina, particularly preferred polycrystalline ceramic substrate materials being pure alumina and hot-isostatically-pressed tetragonal zirconia. Preferred processes further include the steps of sputter-depositing a layer of electrically conductive metal on the sputter etched cutting edge, and then applying an adherent polymer coating on the metal coated cutting edge.

In a particular process, the ceramic material is polycrystalline alumina of about 0.3 micrometer grain size with a thickness of about 0.4 millimeter, and a bend strength in excess of 340 MPa, the grinding operation employs an abrasive wheel with diamond particles of about ninety micrometer grain size, the rough honing operation employs grinding wheels with diamond particles of about twenty two micrometer grain size and the finish honing operation employs sharpening wheels with a one micron diamond particles; the sputter-etched surfaces immediately adjacent the cutting edge have widths in the range of 0.01–0.3 micrometer and an effective included angle substantially greater than the included angle of the mechanically abraded facets; the metal layer has a thickness of less than 500 Angstroms, and the polymer layer has a thickness of less than ten micrometers.

In accordance with another aspect of the invention, there is provided a razor blade that includes a polycrystalline ceramic substrate of less than two micrometer grain size with mechanically abraded facets that have a width of at least about 0.1 centimeter and an included angle of less than twenty degrees, a sputter-etched cutting edge of tip radius less than 300 Angstroms. The resulting low tip radius polycrystalline blade exhibits stability, strength and excellent shaving characteristics.

In particular embodiments, the razor blade polycrystalline ceramic substrate material is selected from the group consisting of silicon carbide, silicon nitride, mullite, hafnia, yttria, zirconia, and alumina, and has a grain size of less than five thousand Angstroms and a bend strength in excess of 300 MPa; the sputter-etched surfaces immediately adjacent the cutting edge have widths of about 0.1 micrometer and an effective included angle substantially greater than the included angle of the mechanically abraded facets, and the blade further includes a sputter-deposited layer of electrically conductive metal of less than five hundred Angstroms thickness on the cutting edge, and an adherent polymer coating of less than ten micrometers thickness on the metal coated cutting edge.

Other features and advantages of the invention will be seen as the following description of particular embodiments progresses, in conjunction with the drawings, in which.

DESCRIPTION OF PARTICULAR EMBODIMENT

Ceramic razor blade blank 10 of polycrystalline aluminum oxide (of about 0.3 micrometers grain size) has a width of about 0.6 centimeter, a length of about four centimeters, a thickness of about 0.4 millimeter, and edge surface 12 to be sharpened to a cutting edge.

Figure 1:
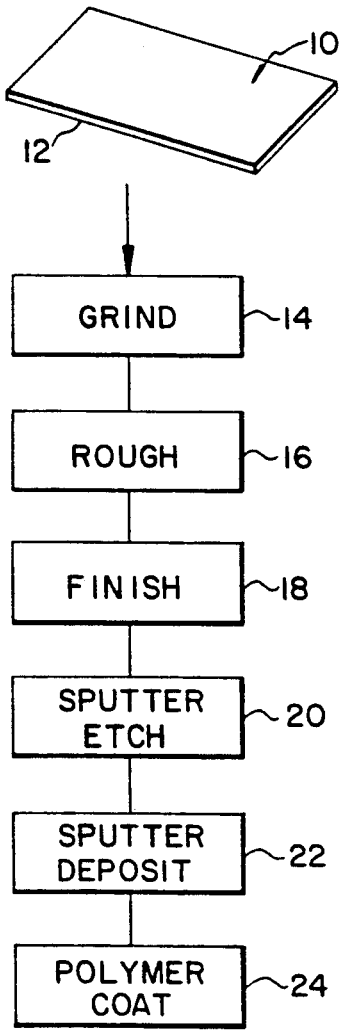
FIG. 1 is a flow diagram indicating a sequence of steps in manufacturing a razor blade in accordance with the invention.
Figure 2:
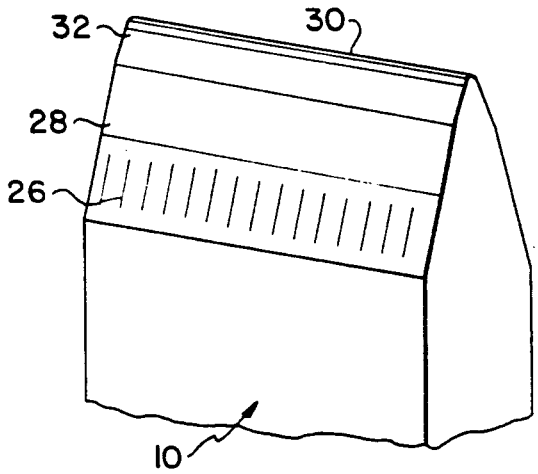
FIG. 2 is a perspective view of a portion of a razor blade in accordance with the invention.

With reference to FIG. 1, blank 10 is subjected to a sequence of edge forming operations including grinding operation 14; rough honing operation 16; finish honing operation 18; sputter-etch operation 20; sputter-deposit operation 22; and polymer coating operation 24 to form a blade edge of cross sectional configuration as diagrammatically indicated in the perspective view of FIG. 2. The blade has grind facets 26 of about 0.3 centimeter width, rough hone facets 28 of about 0.2 centimeter length, and a tip 30 that has an included angle defined by finish facets 32 of about fourteen degrees and a edge radius of about 460 Angstroms (the edge radius being defined as the radius of the largest circle which can be accommodated at the ultimate tip 30 when viewed with a scanning electron microscope).

In the grinding operation 14, the blade blank is fed, at a transfer speed of 270 centimeters per minute, past a diamond abrasive (diamond particles of about ninety micrometer grain size) wheel with an oil flow of 1.8 liters per minute and the wheel rotating into the blade edge at 1100 RPM, a set angle of 4.5 degrees (the angle between the plane of the blade 10 and a tangent to the wheel where the blade makes contact with the wheel), a sharpening infeed of 0.4 millimeter (the blade holder deflection by the sharpening wheel), and a spring force of about 1.4 kilograms, to form grind facets 26 that have an included angle of about nine degrees and a length of about 0.3 centimeter.

The grind facets 26 are then smoothed by diamond abrading wheels at the rough honing stage 16 to form rough hone facets 28 that have an included angle of nine degrees and a width of about 0.2 centimeter. The grinding wheels at the rough hone stage have a diamond particle size of about twenty two micrometers and are rotated at a speed of 1100 RPM into the blade with an oil flow of 1.8 liters per minute with a set angle of 4.7 degrees, a sharpening infeed of 0.5 millimeter and a spring force of about 1.4 kilograms, and the blade is fed at a transfer speed of 360 centimeters per minute.

The rough honed blade edge 12 is then subjected to a finish honing operation at stage 18 in which the blade edge is abraded to form finish hone facets 32 of about fourteen degrees included angle and a width of about one centimeter. The sharpening wheels at the finish hone stage have a diamond particle size of about one micron and are rotated at a speed of 1130 RPM away from the blade with a set angle of 8.0 degrees, a sharpening infeed of 0.2 millimeter and a spring force of about one kilogram, and the blade is fed at a transfer speed of 170 centimeters per minute.

The sharpened blades are then degreased in methylene chloride and solvent-washed ultrasonically in Freon. The degreased and particulate free blades are placed in a sputtering chamber with the blade secondary axis parallel to the cathode normal at a substrate-to-target distance of about seven centimeters. The sputtering chamber is evacuated to a pressure of equal to or better than $2\times10^{-6}$ torr, and argon is introduced to attain a sputtering gas pressure of ten millitorr. 13.56 megahertz RF power is applied to establish a stable plasma with 200 watts RF forward power and an etch duration of about 2.5 minutes to reduce the radius of tip 30 to about two hundred Angstroms while increasing the included angle defined by surfaces 34 immediately adjacent tip 30 as diagrammatically indicated in FIG. 3. Sputter-etched surfaces 34 have lengths of about 0.08 micrometer.

Following the sputter-etch procedure 20, the sputter unit is switched from etch mode to deposition mode using a matching network selector; a plasma is ignited at 400 watts and ten millitorr pressure, a chromium-platinum target is presputtered for five minutes with a substrate shield between the blades and the target. Upon completion of presputtering, the substrate shield is retracted and released atoms of chromium and platinum are deposited on the sharpened blade edges to form a stabilizing metallic layer 36 of about three hundred Angstroms thickness.

A coating 38 of polytetrafloroethylene telomer is then applied to the edges of the blades in accordance with the teaching of U.S. Pat. No. 3,518,110. This process involves heating the blades in an argon environment and providing on the cutting edges of the blades an adherent coating 38 of solid PTFE.

Figure 3:
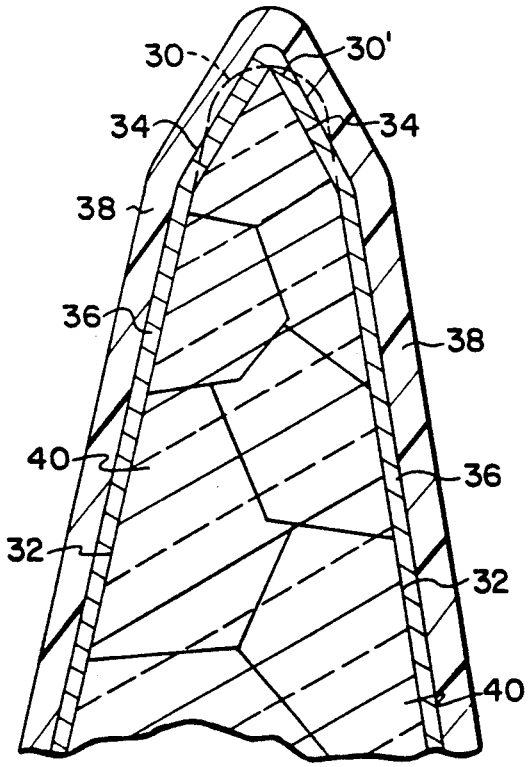
FIG. 3 is an enlarged diagrammatic view of the tip of the razor blade shown in FIG. 2.

A diagrammatic view of the resulting blade edge (magnified about fifty thousand times) is shown in FIG. 3. The radius of the modified (sputter etched) tip 30' is about two hundred Angstroms (significantly smaller than the grain size of the ceramic crystals diagrammatically indicated at 40) and the included angle of the sputter-etched surfaces 34 forming the modified tip 30' is greater than forty degrees. The blades exhibit excellent shaving properties and adequate shaving life.

While a particular embodiment of the invention has been shown and described, various modifications will be apparent to those skilled in the art, and therefore, it is not intended that invention be limited to the disclosed embodiment, or to details thereof, and departures may be made therefrom within the spirit and scope of the invention.

What is claimed is:

1. A process for forming a razor blade comprising steps of providing a polycrystalline ceramic substrate that has a grain size of less than two micrometers, mechanically abrading an edge of said polycrystalline ceramic substrate to form a sharpened edge thereon that has an included angle of less than twenty degrees; and sputter-etching said sharpened edge to form a cutting edge that has a tip radius of less than 300 Angstroms.

2. The process of claim 1 wherein said polycrystalline ceramic substrate is mechanically abraded in a sequence of grinding, rough honing and finish honing steps with diamond abrasive material.

3. The process of claim 1 wherein said step of mechanically abrading an edge of said polycrystalline ceramic substrate forms a sharpened edge thereon that has a tip radius in the range of 600 to 1000 Angstroms.

4. The process of claim 1 wherein said polycrystalline ceramic substrate material is selected from the group consisting of silicon carbide, silicon nitride, mullite, hafnia, yttria, zirconia, and alumina.

5. The process of claim 1 wherein said ceramic substrate has a bend strength in excess of 300 MPa.

6. The process of claim 1 and further including the steps of sputter depositing a layer of electrically conductive metal on said cutting edge, and then applying an adherent polymer coating on said metal coated cutting edge.

7. The process of claim 6 wherein said sputter-deposited layer of electrically conductive metal on said cutting edge has a thickness of less than five hundred Angstroms, and said adherent polymer coating on said metal coated cutting edge has a thickness of less than ten micrometers.

8. The process of claim 6 wherein said polycrystalline ceramic substrate material is selected from the group consisting of alumina and zirconia.

9. The process of claim 1 wherein said sputter-etching of said sharpened edge to form said cutting edge provides sputter-etched surfaces immediately adjacent said cutting edge of width in the range of 0.01–0.3 micrometer and an effective included angle substantially greater than the included angle of said mechanically abraded facets.

10. The process of claim 9 wherein said polycrystalline ceramic substrate material is selected from the group consisting of pure alumina and hot-isostatically-pressed tetragonal zirconia that has a bend strength in excess of 300 MPa and a grain size of less than 0.5 micrometers, and further including the steps of sputter depositing a layer of electrically conductive metal on said cutting edge to a thickness of less than five hundred Angstroms, and then applying an adherent polymer coating on said metal coated cutting edge to a thickness of less than ten micrometers.

* * * * *